United States Patent [19]

DeCloux et al.

[11] Patent Number: 4,496,147

[45] Date of Patent: Jan. 29, 1985

[54] EXERCISE STAIR DEVICE

[75] Inventors: Richard J. DeCloux, Manchester, N.H.; Herbert H. Loeffler, Arlington, Mass.; James S. MacConkey, Winchester, Mass.; E. Hubbard Yonkers, Watertown, Mass.

[73] Assignee: Arthur D. Little, Inc., Cambridge, Mass.

[21] Appl. No.: 357,791

[22] Filed: Mar. 12, 1982

[51] Int. Cl.[3] ..... A63B 21/00; A63B 23/04

[52] U.S. Cl. ..... 272/130; 272/70; 272/DIG. 1; 272/DIG. 4

[58] Field of Search ..... 272/70, 70.3, 70.4, 272/130, DIG. 1, DIG. 4, DIG. 9; 73/379; 417/226, 227; 128/25 R, 25 B; 182/42, 43, 44, 54

[56] References Cited

U.S. PATENT DOCUMENTS

| | | | |
|---|---|---|---|
| 1,082,940 | 12/1913 | Flora | 272/69 |
| 1,909,190 | 5/1933 | Sachs | 272/70 |
| 1,982,843 | 12/1934 | Traver | 272/70 |
| 3,128,094 | 4/1964 | Wolf | 272/70 |
| 3,511,500 | 5/1970 | Dunn | 272/130 |
| 3,529,474 | 9/1970 | Olson et al. | 272/130 X |
| 3,970,302 | 7/1976 | McFee | 272/130 |

FOREIGN PATENT DOCUMENTS

| | | | |
|---|---|---|---|
| 588612 | 5/1947 | United Kingdom | 417/226 |
| 2010101 | 6/1979 | United Kingdom | 272/70 |

*Primary Examiner*—Robert A. Hafer
*Assistant Examiner*—Arnold W. Kramer
*Attorney, Agent, or Firm*—Weingarten, Schurgin, Gagnebin & Hayes

[57] ABSTRACT

Apparatus which simulates the exercise obtained while climbing stairs includes two hydraulically phased steps retained in adjacent inclined tracks in which the steps are supported in a hydraulically open-ended system, with the phasing of the steps being controlled by a pair of in-line hydraulic actuators, one each associated with a step, in which fluid forced from one actuator with a downward movement of the associated step is channeled through a variable restricted orifice to the other actuator to raise the other step. In one lightweight, compact embodiment, the device is collapsed down to a compact size through the use of steps which are foldable to the track, and through the use of a track foldable to the frame. In its open position the lower portion of the frame props up the track at an appropriate climbing angle, with upper portions of the frame extending above the track to serve as handles positioned above the center of travel of the steps.

10 Claims, 14 Drawing Figures

EXERCISE STAIR DEVICE

FIELD OF INVENTION

This invention relates to exercise devices and more particularly to an exercise stair which simulates the exercise encountered during the climbing of stationary stairs.

BACKGROUND OF THE INVENTION

One exercise device which simulates the exercise encountered during the climbing of stationary stairs is described in U.S. Pat. No. 3,970,302, issued to Richard McFee. In this exercise device, moveable steps are provided on an inclined track, with the counterforce being provided hydraulically, in one case by actuation of a hydraulically damped variable pivot lever and in another case by a hydraulic motor. In both of these cases, the steps are moved in opposition or phased mechanically such that when one step is moved downwardly by the weight of an individual, the other step is moved upwardly. In the McFee patent, the mechanical phasing of the steps is accomplished by a wire or chain from one stair to the other over a pulley or hydraulic motor sprocket. The mechanical phasing assures that when one step goes up by a predetermined amount, the other step will come down by this predetermined amount. It should be noted however that should the wire or chain break, the steps are unsupported and an individual can fall off the device. As will be appreciated, mechanical phasing results in a large number of moving parts and mechanical linkages which are noisy, cumbersome and expensive. Moreover, both the pivoted arm embodiment and the hydraulic pump embodiment of the McFee patent are difficult to implement because they do not accommodate the expansion of the hydraulic fluids occasioned by temperature increases associated with use, as energy expended by the user's efforts is absorbed. Also significant backlash accompanies use of these two embodiments which is annoying. Moreover, in the pump embodiment it is extremely difficult to provide a pump which acts symmetrically in both directions. Additionally, neither of the two McFee embodiments allow for compact packaging because the phasing apparatus is bulky and in one embodiment is accomplished by a large number of mechanical parts not conveniently housed in a flat package which would permit compact storage and ready portability.

Additionally, in any conveniently sized pivoted arm embodiment, to adjust the counterforce by 5% for a 100 lb. person corresponding to a change in climbing rate from 60 ft. per minute to 63 ft. per minute, the fulcrum of the pivoted arm is to be changed by less than ⅛ inch, which is virtually impossible to do. This severely limits repeatability of the counterforce setting and the ease with which the counterforce can be varied. Repeatability of the counterforce setting is important because exercise regimens specified by exercise physiologists often progress in intensity from one week to another by increments of only 5% or less.

It will, however, be appreciated that the device described in the above-mentioned patent has advantages over other types of exercise devices such as rowing machines, stationary exercise bicycles, and endless belt walkers.

By way of further background, with respect to exercise bicycles, these devices rely on a pedal driven wheel and either a roller or brakes for providing the counterforce. The problem with these types of exercise devices is the extra amount of effort necessary to start the wheel moving from a dead stop. Moreover in the case of brakes, after the static coefficient of friction has been overcome, the brake pads or strap provide relatively little counterforce. Thus, adjustment of such a device is difficult.

Aside from getting the wheel started, in all of the above-mentioned devices, the amount of counterforce is not readily adjustable and is non-linear. More specifically, the above-mentioned exercise cycles are to a certain extent speed sensitive in that the counterforce applied to the reaction part actuated by the user is speed dependent. For instance in the exercycle, the counterforce lessens substantially as the user exercises since the heating up of the friction pads results in a decreased coefficient of friction during exercise. This is also true for the resilient rim exercycles in which the roller forms a standing wave which makes the exercycle easier to pedal.

By way of further background, perhaps one of the more important problems in terms of home use exercise devices is the noise and vibration associated with these devices. When these devices are utilized in apartments, for instance, the noise and vibration can be so significant that the user is required to forego the use of the exercise device due to the annoyance it causes neighbors. Moreover, if the user prefers to watch television or listen to radio during exercise, the exercise device is sometimes so noisy that it drowns out either the television or the radio. In all of the prior art devices mentioned above, there are a plurality of mechanical parts and mechanical linkages which are inherently noisy. For instance, bike chains, rollers and pivoted levers are amongst those mechanical devices which create considerable noise during operation.

SUMMARY OF THE INVENTION

The subject device is an all-hydraulic, quiet exercise stair device having a pair of steps which move in opposition along an inclined track. The steps are linked together hydraulically in an open-ended system in which the fluid from one hydraulic actuator supporting one step is metered through a variable orifice metering valve to the actuator for the other step and visa-versa so that the rate at which the steps may be actuated is infinitely and linearly variable by controlling the flow rate from one actuator to the other. The subject device has the advantages of repeatability and easy adjustability of flow rate which sets the speed, gentle failure mode, permits fluid expansion, low noise and compactness.

It is a feature of this hydraulic system that restricting the orifice decreases the flow rate which increases the time for a step to descend with a given body weight. This means that the exercise rate is slower and therefore the equivalent climbing rate is slower. To obtain more exercise, the orifice is opened to permit more rapid stair climbing. This means that the number of step actuations per minute may be increased, and in fact can be increased to such an extent that it is equivalent to running up stairs or a slope. Thus, aerobic exercise is increased with an increase in the orifice of the metering valve, thereby increasing heart rate, respiration rate, and resultant caloric burn-off. The system thus controls the maximum rate at which a user may exercise in a very convenient fashion.

Moreover, the increased volume of hydraulic fluid that occurs as a result of the increased temperature during exercise is accommodated by a rise in the position of the steps. Thus, the present invention accommodates thermal expansion of the hydraulic fluid during exercise without special valving, accumulators or additional cooling elements since expansion of the fluid merely increases the step height.

As important, the steps are phased hydraulically rather than mechanically. The use of the totally hydraulic system without mechanical phasing results in an exceptionally quiet, simple system. Moreover in its failure mode, the subject device deposits the individual gently to floor level as opposed to abruptly dropping him.

The hydraulic actuator utilized to support the stairs or steps may employ either a hydraulic ram or a piston cylinder. The hydraulic ram has only one seal, namely the rod seal, as opposed to a rod seal and a piston seal used in a piston cylinder. The use of hydraulic rams avoids internal leakage problems associated with piston seals because no piston seal is used. Moreover, the hydraulic ram is lower in manufacturing cost. With respect to external leakage in open-ended systems, hydraulic rams are preferable because low cost piston cylinders invariably leak oil which can damage carpeting or rugs.

In one embodiment, the hydraulic cylinders are flexibly mounted to a base plate and are provided with a flexible interconnection between the end of a hydraulic cylinder and the metering valve, such that the actuator rods in the hydraulic cylinders may move off-axis without side forces on the rod seal. The main purpose of the flexible mounting is to eliminate side forces on the rod seal. Elimination of side loading greatly enhances rod seal life and avoids leaks. Since leaks are a major fault mode of hydraulic systems, this is an important product life factor. The reliability of this type mounting system also increases the safety of the device as well as the longevity of the hydraulic actuators.

The compactness and stowability of the subject exercise stair in one embodiment is due in part provided by in-line, hydraulic cylinders carried totally within the track so as to achieve a flat package. Additionally, for storage the steps are foldable to the track and the track is folded to a frame to which it is hinged. The lower portion of the frame serves to prop up the track at a predetermined angle, with upper portions of the frame extending above the track serving as handles. In a preferred embodiment the handles are telescoping and are positioned above the center of travel of the steps. Various frame/track folding methods are described hereinafter.

When not in use, the frame is pivoted or swung to a point parallel to and flush with the track. In one embodiment, the steps are folded down to the plane of the track such that the entire device may be conveniently stowed, especially under a bed. With the frame swung into place parallel to the track, wheels on the frame contact the floor such that the entire device may be moved wheelbarrow fashion.

While the subject exercise stair is extremely quiet in operation due to the simplicity of its operation, the exercise stair can be made even quieter through the utilization of oil-impregnated wooden skids for the steps instead of the rollers used in the aforementioned McFee patent. In one embodiment the oil-impregnated wooden skid is 60% oil by weight.

BRIEF DESCRIPTION OF THE DRAWINGS

These and other features of the subject invention will be better understood in connection with the detailed description taken in conjunction with the drawings of which.

DETAILED DESCRIPTION

Figure 1:
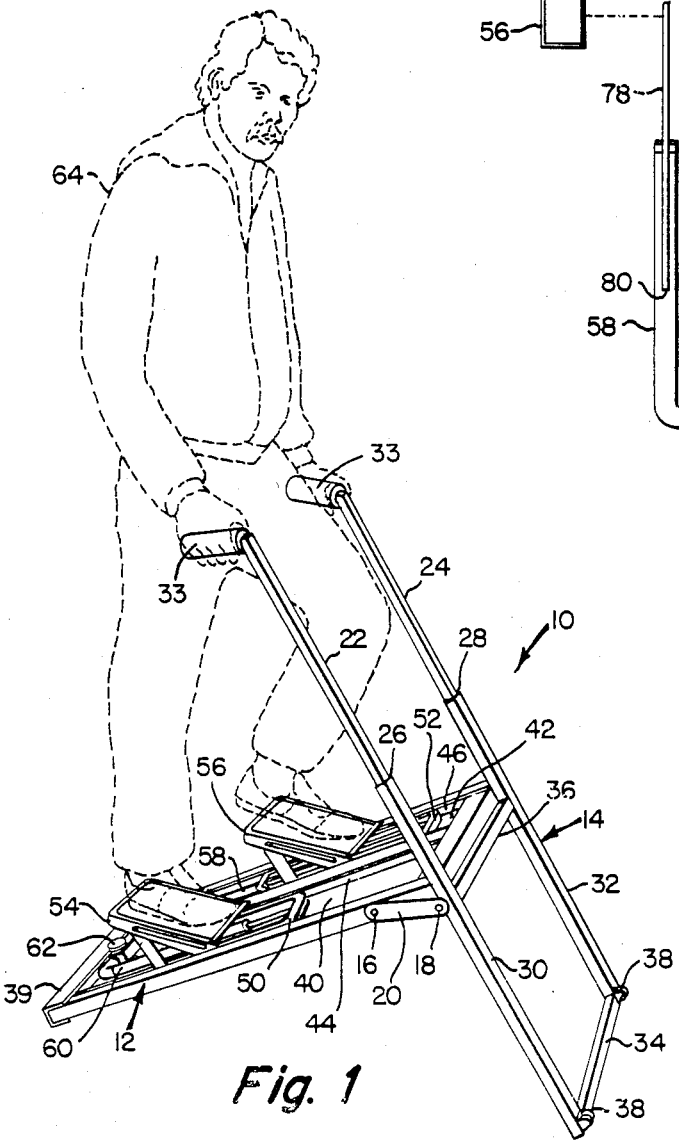
FIG. 1 is a diagrammatic illustration of the subject exercise stair illustrating hydraulic phasing and the hinged frame configuration.

In order to provide for an exercise device in which the counterforce to the individual is easily controlled and referring now to FIG. 1, in one embodiment an exercise stair 10 is provided with a dual track 12 and a frame 14 which is double-hinged at 16 and 18 with a hinge strap 20 such that the assembled exercise device takes on an A-frame configuration with an inclined track 12 and an inclined frame 14.

Extensible arms 22 and 24 are telescoped from the upper porttions 26 and 28 of upstanding frame members 30 and 32 such that the handle portions 33 are positioned above the tracks preferably at the midpoint in the travel of the steps in their tracks. A bottom cross member 34 is provided to complete the bottom of the frame, whereas a horizontal spacing member 36 is provided at a point adjacent hinge point 18, yet far enough from the track to prevent pinching if spacing member 36 is held during opening of the device. The bottom of the frame is provided with wheels 38 as illustrated.

Inclined track 12 is provided with tracks generally indicated at 40 and 42. Channels 44 and 46 in respective tracks house carriages 50 and 52. Steps 54 and 56 are mounted to carriages 50 and 52 respectively, with the carriages being supported hydraulically by in-line, full stroke hydraulic actuators 58 and 60.

Actuators 58 and 60 are connected hydraulically at their bases by an adjustment or metering valve 62 which controls the counterforce to the individual, here illustrated in dotted outline at 64, as the individual shifts his weight to a step which is to be moved downwardly. As will be described, in one embodiment carriages 50 and 52 are mounted for reciprocation within their respective tracks in a sliding fit.

In operation, the individual utilizing the exercise stair steps down on one step which offers resistance to the individual's weight in accordance with the setting of valve 62. When the step associated with this downward pressure reaches its lower limit, the individual then shifts his weight to the upper step and the process is repeated such that the equivalent of stair climbing exercise is achieved.

Figure 2:
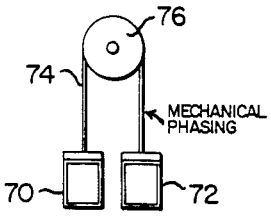
PRIOR ART Fig. 2
FIG. 2 is a schematic illustration of a prior art system for phasing stairs illustrating a mechanical phasing technique.

As mentioned hereinbefore, the phasing of the steps, that is the movement of one step relative to the other, is achieved completely hydraulically with no mechanical phasing of the steps involved. Referring to FIG. 2, in the prior art steps 70 and 72 are mechanically linked together by a cable or chain 74 which runs over a pulley 76 such that as one step descends, the other moves up to the exact extent that the opposing step moves down. It has been found that it is not necessary to obtain the feel of stair climbing, that one step move up precisely by the same amount that the other step moves down. This permits complete hydraulic phasing of the steps such as illustrated in FIGS. 3 and 4, and also provides an extremely quiet exercise device.

Figure 3:
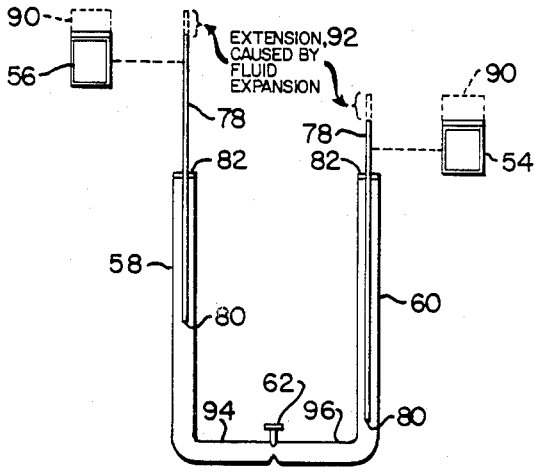
FIG. 3 is a schematic illustration of the hydraulic system utilized for mechanical phasing of the stairs of FIG. 1.
Figure 4:
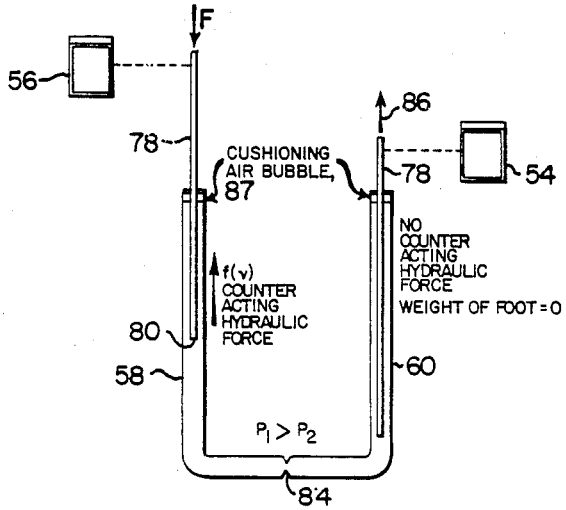
FIG. 4 is a schematic illustration of the hydraulic phasing system of FIG. 3, illustrating the direction of the counterforce provided for the actuator coupled to the stair which is moving downwardly.

Referring to FIG. 3, in a preferred embodiment each actuator is a hydraulic ram as opposed to a piston cylinder which has both piston seals as well as rod seals. Each ram is a rod 78 mounted for translation in a cylinder. Note that the only sealing is that which is accomplished at the top of the actuators by rod seals 82 as illustrated. The rod seals are preferable to piston seals because rods can be inexpensively manufactured to tighter tolerances than can the inside dimension of a conventional hydraulic cylinder to which a piston is sealed. While it is possible to utilize conventional hydraulic cylinders with piston seals at the lower ends of the rods, e.g. piston cylinders, in an open-ended system it has been found that piston seal leakage can occur which results in exterior oil leakage and loss of stroke and phasing. For closed systems if piston seal leakage occurs, stroke and phasing can be restored by use of a bypass involving an additional circuit and valve to return the fluid to the proper side of the piston.

It will be appreciated that that which produces the hydraulic pressure is the end of the rod which is the only surface of the actuator on which the fluid works. Referring to FIG. 4, when a force is applied to the rod in actuator 60 by virtue of the weight of the individual applied to step 56, a counterforce f(v) acts against end 80 of the rod within actuator 58. This flow rate is dependent upon the pressure across variable orifice 84 in which the pressure $P_1$ to the left of this orifice is greater than the pressure $P_2$ at the time that the force f is applied to rod 78 in actuator 58.

With respect to actuator 58, at the time force is applied to actuator 60, rod 78 in actuator 60 will be in its lower position. In terms of the operation of the device, when the individual shifts his weight to step 56, there is no weight applied to step 54 and therefore there is no back pressure across orifice 84 assuming that step 54 is completely unweighted. With step 54 unweighted, the rod within actuator 60 moves in the direction of arrow 86, but moves upwardly slightly more slowly than step 56 descends. There is thus a certain very small time lag in the rise of step 54 with the descent of step 56. It is however a finding of this invention that this time lag is not significant since the user does not particularly care what the unweighted step does as long as it moves upwardly at some time prior to the time that the user wishes to shift his weight to this step. This being the case, it is not necessary to utilize mechanical phasing in order to satisfy the user's need for realistic stair climbing experience. Note that there is a cushioning air bubble 87 at the top of each actuator to damp sharp hydraulic forces which may be applied to the end of the actuator rod by stamping on a step.

As the exercise stair is utilized, energy is imparted to the hydraulic fluid within the actuators. Under ordinary circumstances it is necessary to accommodate the expansion that is built up by the energy imparted to the fluid. However, as illustrated in FIG. 3, when heat is added to the hydraulic fluid, since the system is hydraulically open-ended, the expansion of the fluid with heat results only in a rise in the position of each of the steps as illustrated by dotted outlines 90. The position of each of the steps will rise identically and is caused by an identical extension in the positions of rods 78 as illustrated at 92.

Because of the open-ended hydraulic system, the amount of counterforce provided by each step does not vary perceptibly during use even though a considerable amount of energy is added to the system. All that occurs with extended use is a simultaneous rise in the position of the steps. The resulting expansion of stroke is no problem to the user and it does not effect the exercise rate which is essentially a function of the rate of flow through orifice 84.

The advantages of the total hydraulic open-ended system are the resolution with which the climbing rate can be adjusted by valve 62, the repeatability of the exercise rate with the setting of valve 62, and the uniformity of the counterforce provided by the system. The rate at which the weight is shifted by the individual in the stair climbing exercise does not affect the counterforce to any perceptible degree and thus the subject exercise device is speed independent. The exercise variable is solely the size of the restricted orifice as dictated by valve 62 which sets the maximum rate at which the exercise can be performed, all other parameters being equal, such as the size of the rods, viscosity of fluid over the operating temperature range, and the volume of the actuators.

Additionally, the force necessary to move a step downwardly is uniform over the exercise cycle and there is no starting friction to be overcome. Thus exercise may take place smoothly and at a uniform rate unlike most prior art devices.

With respect to safety, the most likely failure mode of the subject exercise device is either fluid leakage around the seal, a rupture of the actuator, or a rupture of the interconnect lines 94 and 96 between actuators 60 and 58 and valve 62. Upon rupture of any of these lines or actuators, the result is the movement of the steps downwardly but at a controlled rate. The rate is sufficiently slow to deposit the individual at the bottom of the tracks without harm.

TRACK/STEP DETAILS

Figure 5:
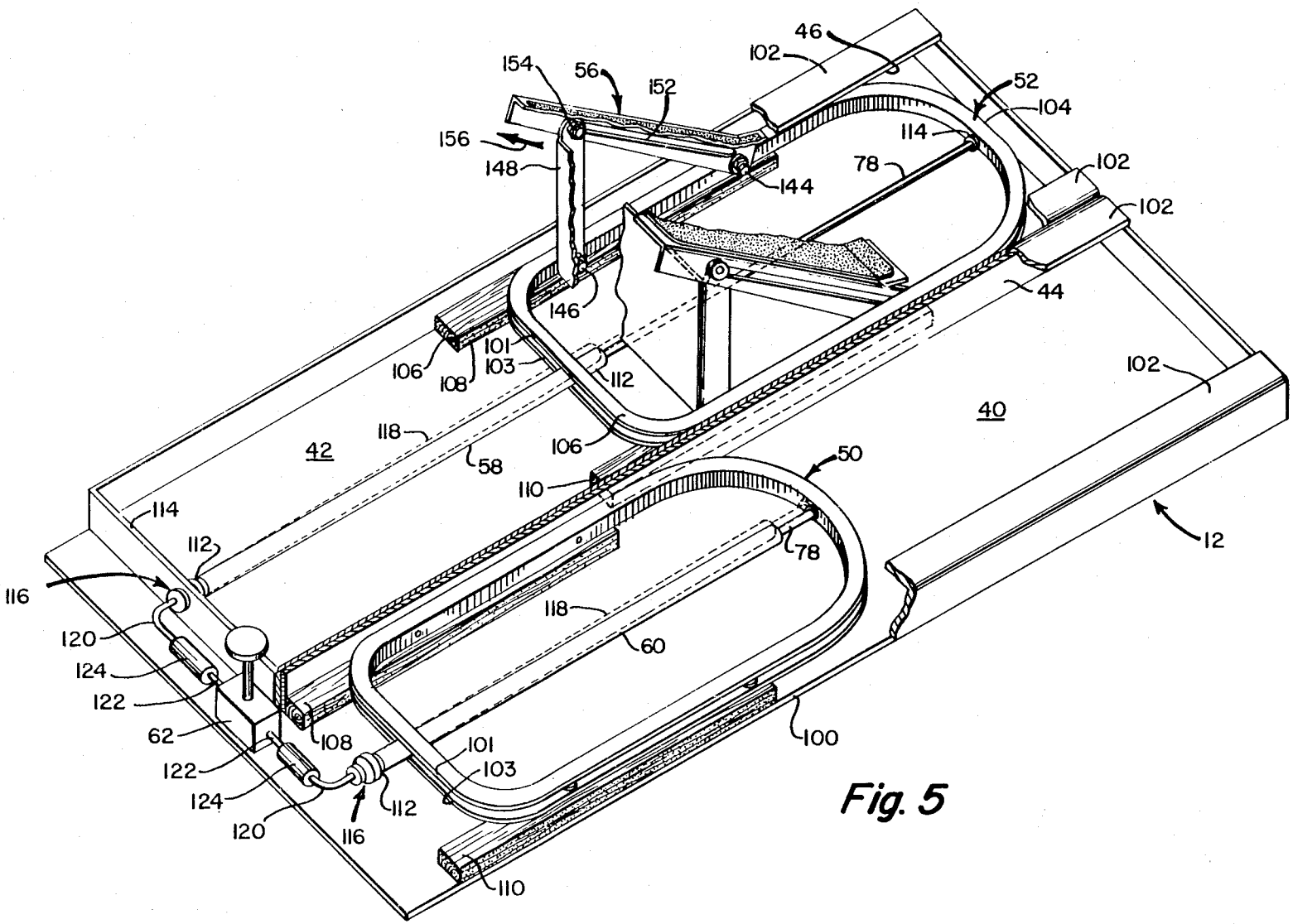
FIG. 5 is a diagrammatic illustration of the stair track illustrating the hydraulic actuator support for the stair steps and flexible base pivots for the actuators.

Referring now to FIG. 5, a detailed cut away view of dual track 12 is illustrated in which like reference characters are utilized for like elements as between FIG. 1 and FIG. 5. With respect to the individual tracks 40 and 42, the bottom portion of the track is made up of a plate 100 which forms the back portion of the track. Channels 102 are mounted to plate 100 such that they are open to each other in pairs as illustrated, and carriages 50 and 52 are mounted in the tracks formed in this manner. In one embodiment each carriage includes a double-plate configuration in which plates 101 and 103 are mounted in spaced-apart adjacency. The carriage has a rounded head portion 104 and rounded bottom corners 106. This double-plate frame is mounted to skids 108 and 110 on either side thereof, with the skids mounted in a sliding fit to the respective track. In a preferred embodiment the skids are made of oil-impregnated wood to eliminate noise associated with systems which use rollers. As mentioned, the oil-impregnated wooden skid is as much as 60% oil by weight.

Actuator 58 is mounted such that a top portion 112 extends through the double-plate structure in a slot (not shown), with the associated rod 78 being attached at 114 to the top portion 104 of carriage 52. Because of the double-plate configuration of the carriage, as illustrated by carriage 50, a major portion of the body of actuator 60 can extend to the interior of the carriage as this carriage is moved downwardly. Thus, the actuator can be made relatively thin and relatively long. In one embodiment the actuator has an inside diameter of 22 mm, with a rod having an outside diameter of 10 mm, the length of the actuator being 18 inches and the length of the rod being 15 inches.

Base 112 of each actuator is mounted to a base plate 114 in a flexible joint generally indicated at 116, so as to accommodate off-axis movement as illustrated by dotted line 118. Each of the connecting lines between the actuators, here illustrated at 120 and 122, has an intermediate flexible linkage 124 so as to accommodate the off-axis movement of the actuators. This flexible connection is illustrated in greater detail in FIG. 6.

Figure 6:
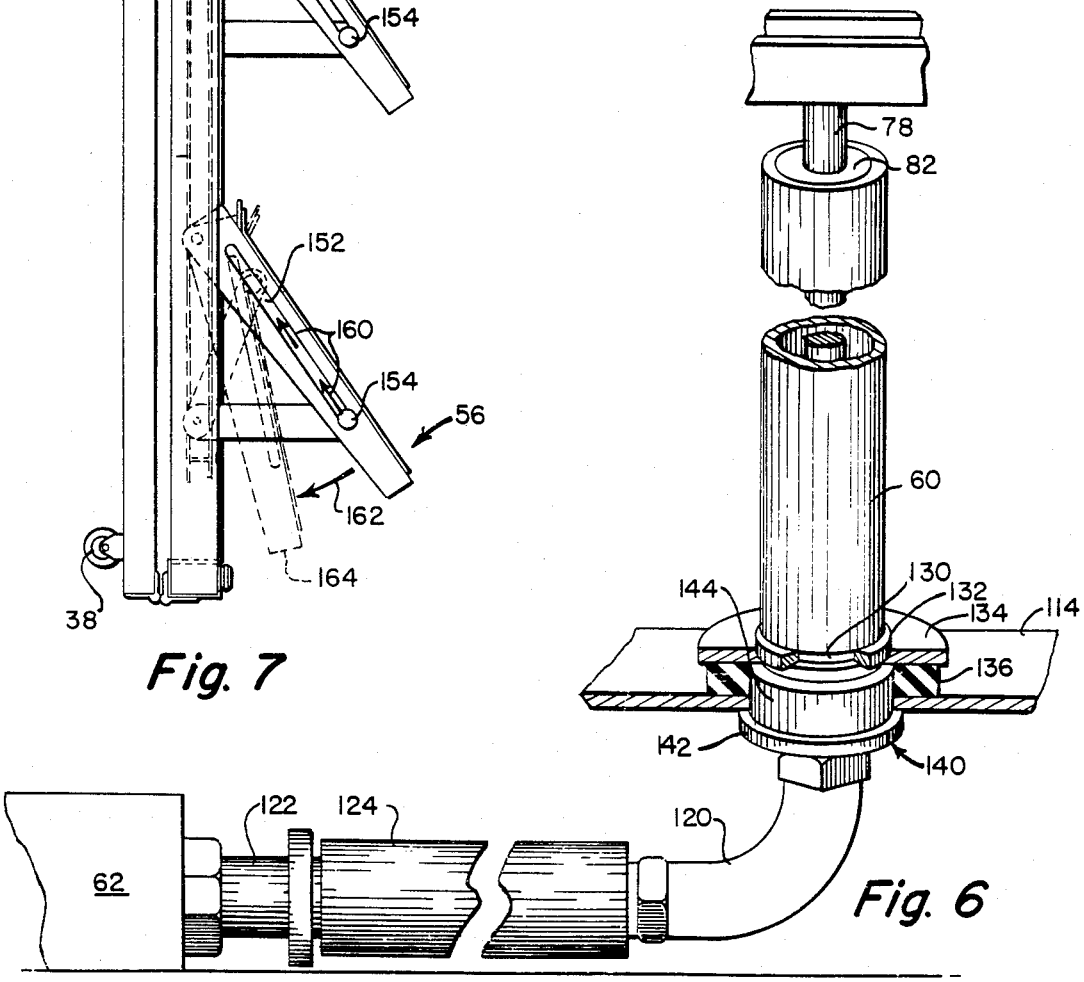
FIG. 6 is a diagrammatic illustration of the flexible joint for the base of the actuator of FIG. 5.

Referring to FIG. 6, the base of actuator 60 is provided with an annular groove 130 in which is located a C-ring 132 which limits the upward movement of a rigid washer 134 which bears down on a resilient gasket or washer 136. C-ring 132 limits the downward movement of actuator 60, whereas an insert 140 prevents upward movement of actuator 60. In one embodiment, insert 140 has an annular flange 142 and a cylindrical extension 144 which is friction fit to the exterior or outer dimension of the base of actuator 60.

The resiliency of washer 136 permits off-axis movement of actuator 60 in such a way that the actuator may cant relative to base plate 114. Any canting of the actuator is accommodated by the resilient or flexible connection provided by linkage 124. This configuration permits limited movement of the actuators and reduces the amount of leakage at seal 82 due to wear from side loading caused by manufacturing tolerances which result in lateral carriage motion within the tracks.

FOLDING FOR STORAGE

As mentioned, one of the features of the subject exercise stair is its easy stowability due to its compact design. The containment of all of the hydraulics within the track permits the device to be folded such that the track lies against the support frame. As will be described, there are a number of methods for permitting this folding as demonstrated by the devices of FIGS. 7, 9, 10, 11 and 12. Moreover foldable steps, telescoping arms and wheels shown in FIGS. 5 and 8 also contribute to the compact, portable design.

Referring to FIG. 5, step 56 is mounted to carriage 52 at hinge points 144 and 146 in which the top portion of the step is hinged at 144. An upstanding support 148 is hinged at 146, with step 56 being provided with a downwardly projecting flange 150 having a slot 152 extending along the length thereof. The weight of an individual on a step urges pin 154 in the direction of arrow 156 until it reaches the end of slot 152. Thus step 56 provides steady support for the weight of the individual.

Figure 7:
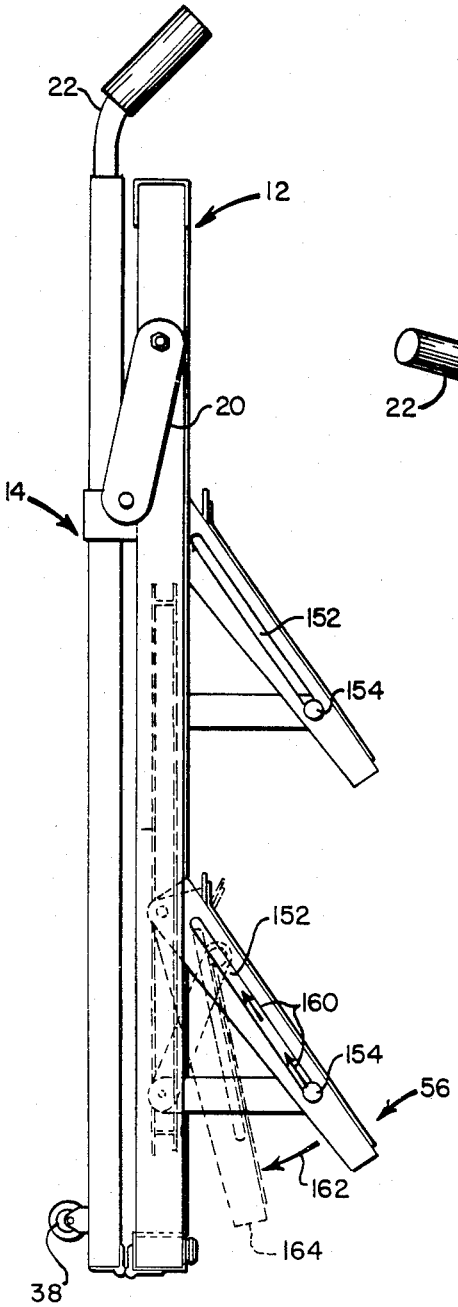
FIG. 7 is a side view of the exercise stair showing the folding of the frame to the track and also illustrating the collapse of the steps to a position flush with the track.

As also illustrated in FIG. 7, the steps may be collapsed for storage into the plane of dual track 12 by moving step 56 up and then down. This causes pin 154 to move in the direction of arrows 160 which causes step 56 first to move upwardly and then downwardly as illustrated by arrow 162 so that it moves to a position illustrated in phantom at 164, which is an intermediate position. Thereafter, the step may be moved until it is flush with the top surface of track 12.

FIG. 7 also serves to show the collapsed configuration of the exercise stair in which frame 14 is folded flush with the track 12, with arms 22 or 24 telescoped into the frame. The folding of the stair to its collapsed position is a function of the double-hinged pivot 20. The operation of double-hinged pivot 20 will be described in connection with FIGS. 9 and 10.

Figure 8:
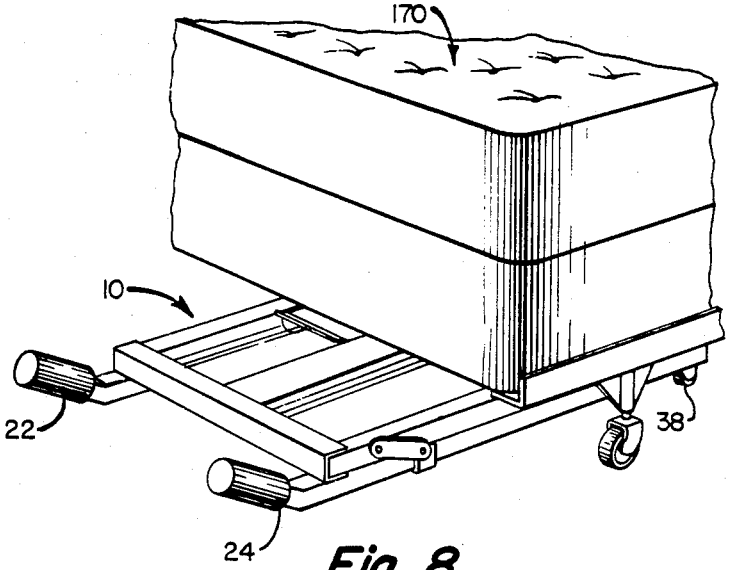
FIG. 8 is a diagrammatic illustration of the storage of the subject exercise stair underneath the bed in its folded or collapsed condition.

Referring to FIG. 8, the collapsed exercise stair 10 may be easily positioned under a bed 170 by virtue of wheels 38 and telescoping handles 22 and 24 which effectively provide a wheelbarrow structure.

Figure 9:
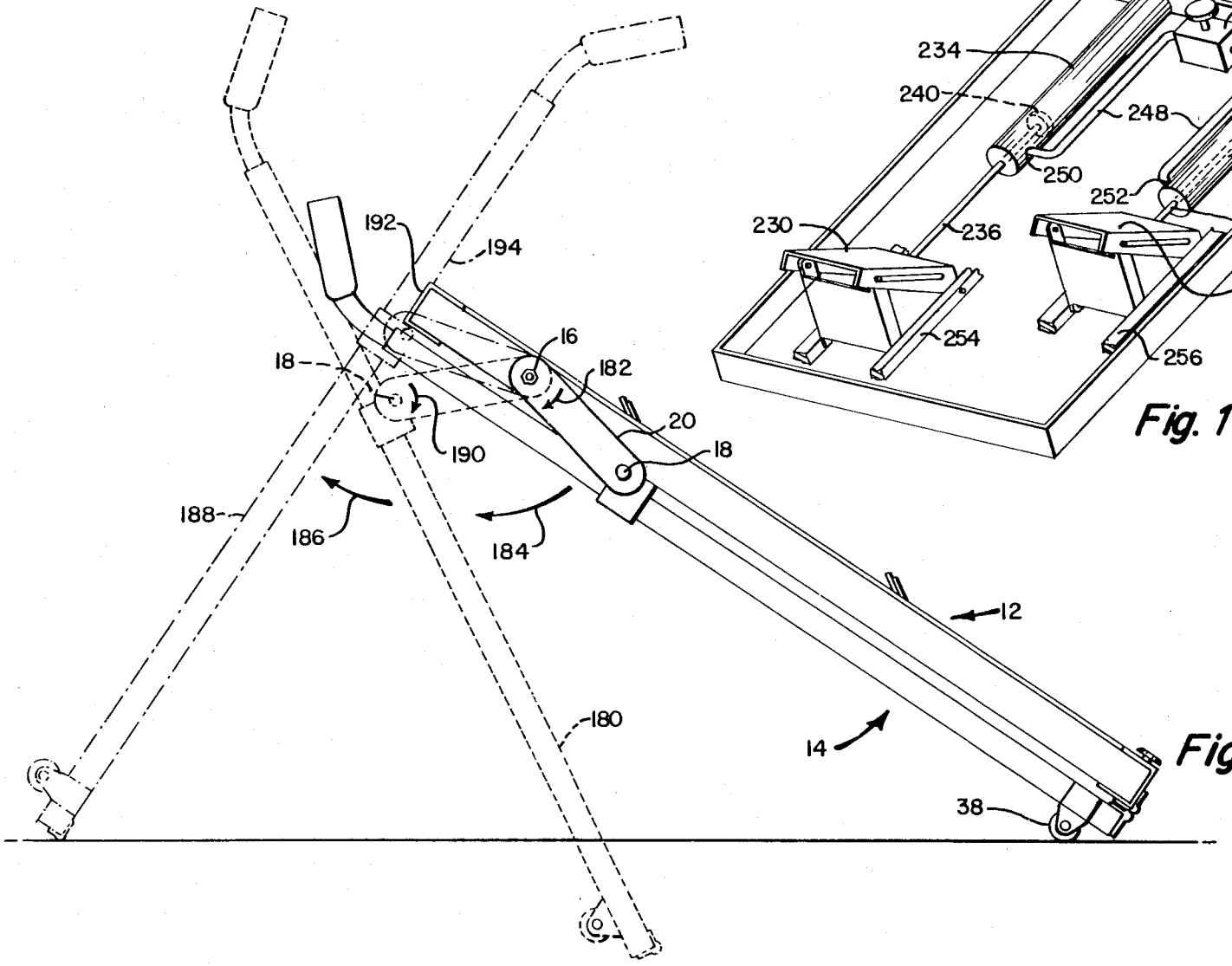
FIG. 9 is a side view of the subject exercise stair illustrating in phantom, the swinging of the frame away from the track.

Referring now to FIG. 9, in one embodiment the assembly of the exercise stair from its collapsed position as illustrated in FIG. 7 to its operating position includes the swinging away of frame 14 from track 12 as illustrated at dotted outline 180. In order to accomplish this, hinge strap 20 is rotated in the direction of arrow 182 with the pulling away of the frame from the track. This movement is also illustrated by arrow 184. Further movement as illustrated by arrow 186 causes frame 14 to be rotated into place as illustrated at dotted outline 188, with the frame being rotated about pivot 18 as illustrated by arrow 190. When in position, end 192 of track 12 abuts a surface 194 of frame 14 so as to provide for an extremely stable configuration.

Figure 10:
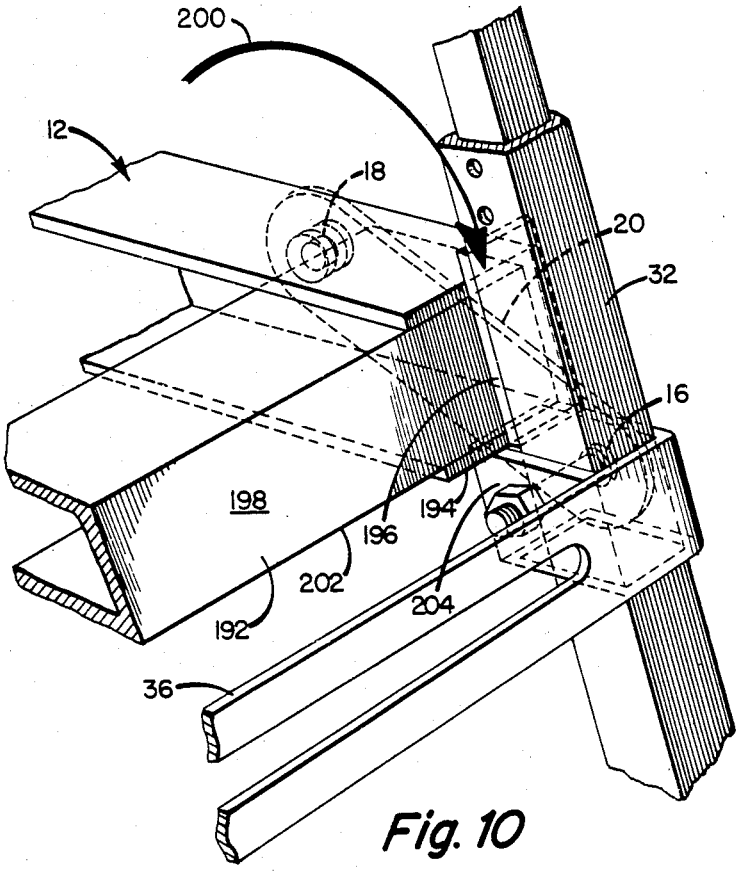
FIG. 10 is a diagrammatic illustration of a portion of the track and a portion of the frame in their assembled position.

As illustrated in FIG. 10, the stability of the FIG. 9 embodiment is in part provided by the compression of member 192 against a plate 196 carried on a face 194 of upstanding frame member 32. Here, member 192 is a cross-member having a flat face 196 which is wedged against the face of plate 196 and is flush with and compressed thereto by virtue of rotation of frame 12 in the direction of arrow 200. The downward movement of the lower edge 202 of member 192 is limited by a stop 204 so that when face 198 is flush with plate 196, the downward travel of member 192 is limited. This compression and downward limiting stop provides for an exceptionally stable assembly. The stability of this type of tight fit utilizing a double-hinged strapped arch configuration is aided by the horizontal running cross piece 34 of the frame as illustrated in FIG. 1, and also by the horizontally running support 39 for the lower edge of the track 12 of FIG. 1. Moreover, since the inner flat surfaces of the hinges are pressed to and overlap the sides of the track on either side, the track is prevented from moving laterally due to the tight bolting of the hinges to the track and the structural rigidity afforded by horizontal spacing member 36. Thus lateral movement of the exercise stair is prevented by the straps and the two horizontally running members which contact the floor, whereas the straps clamp the track to the frame, such that overall stability is provided by the compression of the ends of the track with the upstanding frame members. Note that the straps limit the separation between the bottoms of the track and frame.

Figure 11:
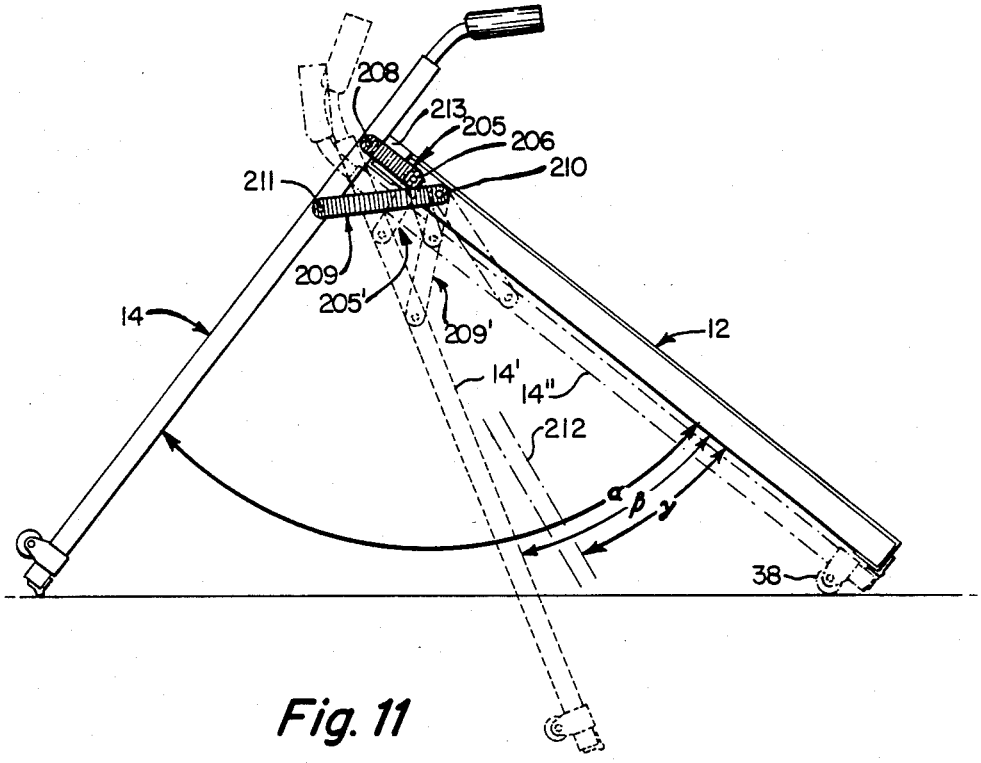
FIG. 11 is a diagrammatic illustration of an alternative track folding method.

Referring now to FIG. 11, the hinged attachment of the track to the frame may be implemented through the utilization of four straps as opposed to two. The use of a 4-bar linkage eliminates any unexpected motions of the frame relative to the track so that the device cannot be set up improperly. This eliminates the necessity for any skill on the part of the user of the device since during folding, the frame goes from perpendicular to the track to a position parallel to the track in a controlled motion. Moreover the 4-bar linkage provides positive positioning in the closed and open positions. In this embodiment a rigid strap 205 is pivoted to track 12 at 206 and to frame 14 at 208. A second rigid strap 209 is pivoted to frame 12 at 210 and to track 14 at 211 such that when frame 14 is moved towards frame 12, it assumes a fixed set of angular orientations with respect to the frame as it moves from its operating position to its folded position and visa-versa. This set of angular orientations is established by virtue of the utilization of the four straps and their multiple hinge points so that the frame cannot flop loosely at a number of different angles during set up and folding. What this accomplishes is that the orientation of the frame relative to the track is established at a set of predetermined angles such that when the frame meets the track in the operating position, the frame is at the appropriate angular orientation $\alpha$. At 14′ midway through the swing of the frame from the track the frame assumes an angular orientation $\beta$ with respect to the track for the position of strap 205 shown at 205′. Note that strap 206 prevents the frame from assuming position 212 at angular position $\gamma$ when strap 205 is at the 205′ position. Thus the frame is not left to flop loose between folded and open positions. Likewise at 14″ when the frame is swung inwardly towards the track, it comes to rest parallel to the track since its position is maintained by virtue of the four straps.

In order to aid in the stability of the assembled device, a block 213 is positioned to limit the upward movement of strap 205 such that when strap 205 rests against the bottom edge of block 213, frame 14 is in the proper position with respect to the track.

Figure 12:
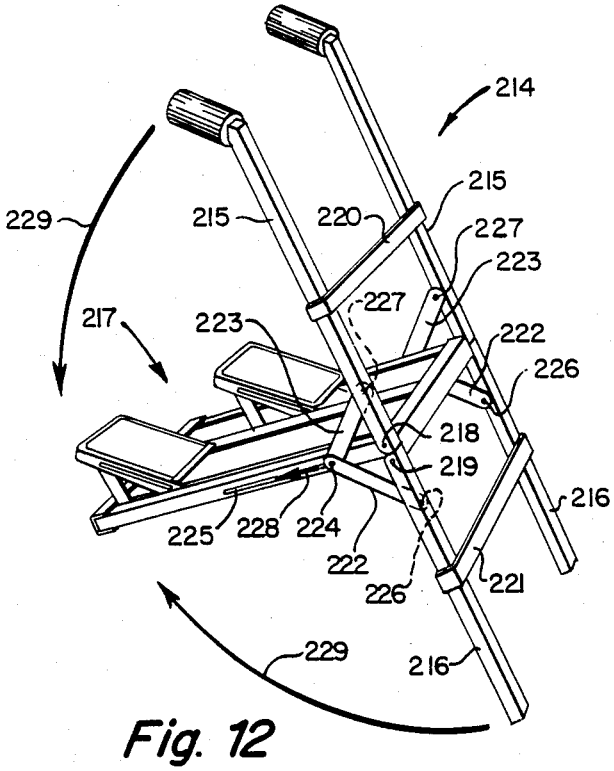
FIG. 12 is a diagrammatic illustration of a still further track folding method.

In an alternative embodiment, and referring now to FIG. 12, the frame 214 may be divided into arms 215 and legs 216 as illustrated. Arms 215 are pivoted to track 217 at pivot points 218 whereas legs 216 are pivoted to track 217 at pivot points one of which is shown at 219. Stabilizing bars 220 and 221 are provided respectively between the arms and the legs to provide lateral stability. The arms and legs are maintained in the positions illustrated by straps 222 and 223, having a common releasably engageable hinge pin 224 mounted through a slot 225 in track 217. The other ends of straps 222 and 223 are pivotally mounted respectively to legs 216 at 226 and to the arms at 227.

In operation, hinge pin 224 is held at the end of slot 225 as illustrated by the force exerted on legs 216. This in turn holds the arms in place. When it is desired to collapse and fold the arms and legs to the track, hinge pin 224 moves in the direction of arrow 228 as the arms and legs are moved in the direction of arrows 229.

In this embodiment the arms and legs are folded down to the plane of the track in a clam shell arrangement to provide an extremely compact and portable device. Setting up of the device merely entails movement of the arms and legs away from the track to the positions shown in FIG. 12.

What has been described are a number of alternative methods of providing a collapsible, compact, portable exercise stair in which props and arms may be readily folded to the track for storage.

Figure 13:
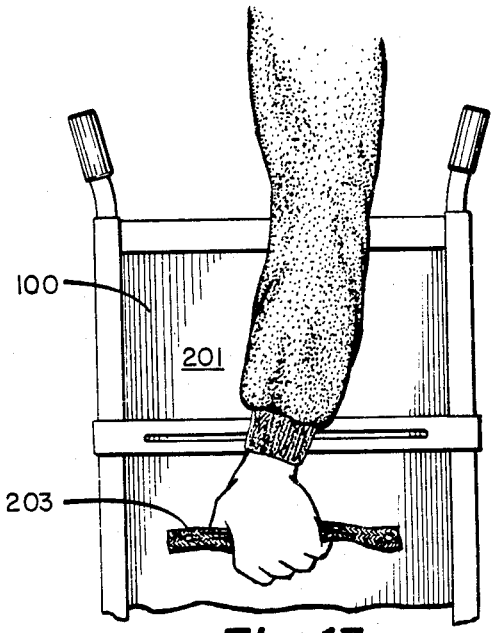
FIG. 13 is a diagrammatic illustration of the positioning of a carrying strap on one side of the track to facilitate carrying; and, FIG. 14 is a diagrammatic illustration of an alternative hydaulic phasing system using rods in tension and piston seals as opposed to rods in compression and rod seals.

With respect to portability, as illustrated in FIG. 13, a back portion 201 of the track plate 100 may be provided with a handle 203 such that the entire device may be carried as illustrated in this Figure.

PISTON CYLINDER EMBODIMENT

Figure 14:
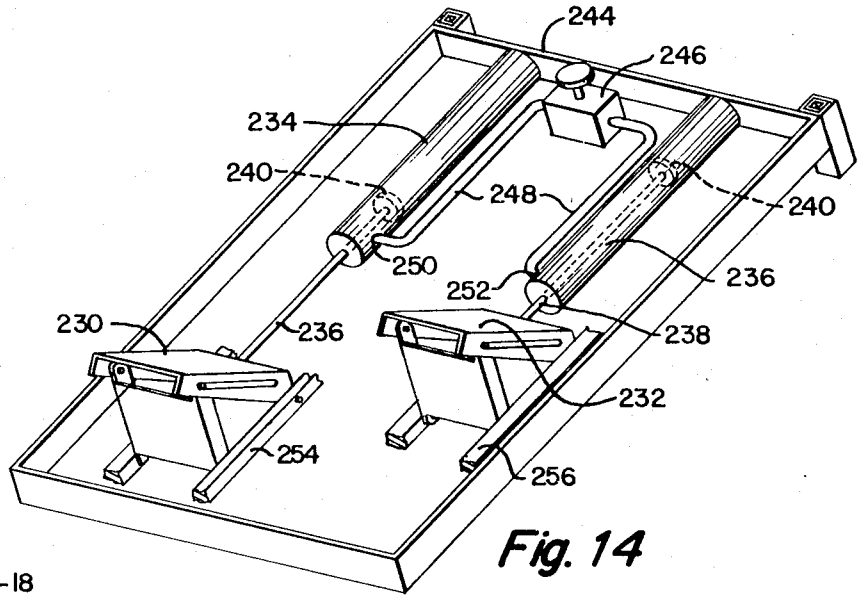

Referring now to FIG. 14, in an alternative embodiment steps 230 and 232 may be hung from hydraulic cylinders 234 and 236 respectively, with each of the steps being coupled to a respective cylinder by a rod 236 and 238 respectively. Piston seals 240 are provided at the end of each of the rods, with the end of the cylinders being mounted to a cross-member 242 within a frame 244. A valve 246 is interposed in a line 248 which communicates with the base of cylinder 234 at point 250, and with the base of cylinder 236 at point 252. Rods 236 and 238 are joined at their other ends to step frames 254 and 256 respectively.

In this embodiment the cylinders are hung from the top of the frame and the steps are supported by rods which are in tension. It will be appreciated that rods in tension can be made smaller than rods in compression which translates into less weight and less cost. Also with the hanging of the cylinders and the rods in tension, there is a convenient self-alignment of the rods within their respective cylinders.

Moreover, in the FIG. 14 embodiment the hydraulic pressure is typically much lower for the hydraulic ram embodiments of FIGS. 1–6. The reason for this is that the effective area of the piston can be larger in a piston cylinder than in a hydraulic ram. The lower operating pressure increases the lifetime of the apparatus and is therefore of advantage.

Additionally, the effect of thermal expansion on stroke can be much less in the piston cylinder embodiment as compared to the positive displacement cylinder. In one embodiment the thermal expansion is one-ninth that of the positive displacement cylinder embodiment.

As a further advantage to the hanging of the cylinders, is the ability to place the adjustment valve in a more convenient position without complicated plumbing and thus higher cost.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. An exercise device comprising:

a pair of inclined side-by-side tracks;

a pair of steps, each mounted for translation in a different one of said tracks and each unrestricted in the amount of stroke during exercise, said steps being phased only hydraulically by an open loop system such that increased fluid expansion during usuage results only in the raising of the steps, thereby eliminating pressure increase due to thermal expansion, said open loop system including said steps and a pair of hydraulic actuators for respective steps, each actuator including a cylinder and a rod disposed therein, with one end of a rod supporting a respective step; means for coupling fluid from one actuator to the other such that as one rod moves in one direction within the associated cylinder, the rod in the other cylinder moves in an opposite direction, said rods in unison being permitted to extend further up each cylinder during usage in accordance with the expansion of the fluid volume in the system due to the energy introduced into the system during usage such that the thermally induced pressure within the system stays substantially contant; and, fluid metering means interposed in said coupling means and including a variable restricted orifice, the size of said orifice determining the fluid flow rate, the stepping frequency, and thus the exercise rate, whereby excercise rate may be easily adjusted.

2. The exercise device of claim 1 wherein said actuators are hydraulic rams.

3. The exercise device of claim 1 wherein said hydraulic cylinders have rods sealed to a respective cylinder only at one end of the cylinder.

4. The exercise device of claim 3 wherein said fluid coupling means includes a fitting at the end of a cylinder opposite that at which a rod is sealed, a conduit from one fitting to said fluid metering means and a conduit from said fluid metering means to the other of said fittings.

5. The exercise device of claim 4 wherein said conduits are flexible.

6. The exercise device of claim 5 wherein each of said tracks includes a cross member adjacent the base thereof and further including flexible means for mounting the end of the cylinder having said fitting to said cross member.

7. The exercise device of claim 1 wherein each of said rods includes a piston seal at one end of said rod.

8. The exercise device of claim 7 and further including means for mounting said cylinders at the top of respective tracks such that said rods depend towards the base of said tracks and means for suspending said steps from the ends of respective rods.

9. The exercise device of claim 1 and further including means including oilimpregnated skids for supporting said steps in said tracks.

10. The exercise device of claim 9 wherein said skids are made of wood.

* * * * *